US007614432B2

(12) United States Patent
Shaw

(10) Patent No.: US 7,614,432 B2
(45) Date of Patent: Nov. 10, 2009

(54) FUNNEL WITH VALVE

(76) Inventor: Shawn Shaw, #31 - 1400 Western Ave, Williams Lake, B.C. (CA) V2G 4S6

( * ) Notice: Subject to any disclaimer, the term of this patent is extended or adjusted under 35 U.S.C. 154(b) by 364 days.

(21) Appl. No.: 11/762,331

(22) Filed: Jun. 13, 2007

(65) Prior Publication Data

US 2007/0295425 A1 Dec. 27, 2007

Related U.S. Application Data

(60) Provisional application No. 60/816,487, filed on Jun. 27, 2006.

(51) Int. Cl.
*B65B 39/00* (2006.01)

(52) U.S. Cl. ..... 141/345; 222/471; 222/530

(58) Field of Classification Search ..... 141/199–205, 141/297–300, 331–345; 222/470–474, 530
See application file for complete search history.

(56) References Cited

U.S. PATENT DOCUMENTS 211,352 A * 1/1879 Smith ..... 141/345
530,690 A 12/1894 James
615,337 A * 12/1898 Altshul ..... 141/201
721,870 A 3/1903 Edison
790,463 A 5/1905 Taliaferro
820,353 A 5/1906 Epperson
1,275,565 A * 8/1918 Junek ..... 141/200
4,901,776 A 2/1990 Attinello

* cited by examiner

*Primary Examiner*—Gregory L Huson
*Assistant Examiner*—Jason K Niesz
(74) *Attorney, Agent, or Firm*—Michael A. Blake

(57) ABSTRACT

A funnel device comprising: a funnel wall, with an interior surface and an exterior surface, the funnel wall generally tapering from an inlet to an outlet; a spout located at the outlet; a reservoir defined generally by the interior surface of the funnel wall; a handle fixedly attached to the funnel wall, the handle located outside of the reservoir; a slideable trigger located on the handle, the trigger slideable with respect to the handle; an annular sealing surface located near the outlet on the interior surface of the funnel wall; a pivotable flapper lever, with a pivot point located generally at a first end of the pivotable flapper lever, rotatably attached to the interior surface of the funnel wall at the pivot point, the pivotable flapper lever having a flapper located generally at a second end of the pivotable flapper lever, and a line attachment point located between the flapper and the pivot point; a passageway in the funnel wall located generally proximal to the trigger; a line with a first end and a second end, the first end attached to the trigger, the second end attached to a line attachment point, and the line entering the reservoir from the trigger via the passageway; a spring attached to the interior surface of the funnel wall and the pivotable flapper lever, and configured to apply a force that tends to keep the flapper sealed against the annular sealing surface.

9 Claims, 4 Drawing Sheets

FUNNEL WITH VALVE

CROSS-REFERENCES

This patent application claims the benefit of provisional patent application Ser. No. 60/816,487 by Shawn Shaw, entitled "Funnel with Trigger Activated Valve", filed on Jun. 27, 2006, the entire contents of which are fully incorporated by reference herein.

TECHNICAL FIELD

The present invention relates to a funnel having an on/off valve or switch. The funnel is of the type having a liquid holding reservoir portion and a tapered outlet.

BACKGROUND

Many prior approaches to providing funnels with shut off elements have been proposed. However, all known prior approaches are somewhat complex and expensive to manufacture, given that they require the valve or occluding element to have substantial weight or spring pressure to assure a complete seal against a hard-to-manufacture distinct valve seat formed in the inner walls of the funnel device.

One such known funnel features a valve which is raised by wires. The valve or occluding element of this known funnel is mounted in the reservoir portion and its sloping sidewalls must match substantially exactly with the tapered walls of the funnel's reservoir in order to provide an adequate liquid-tight seal, this leads to greater expense in manufacturing such a funnel. A further disadvantage of approaches such as disclosed in this known funnel is that the entire outlet spout of the funnel will drain therefrom even after the occluding valve closes, thereby allowing the spillage of excess fluid when one desires to cease the exit of fluid from the funnel outlet.

None of the funnels in the currently known prior art describes a device that allows the user to manually stop and start the flow of liquid in a manner that is simple and easy to manufacture.

Therefore, there is seen to be a need for a funnel with an on/off valve that is relatively simple and inexpensive to manufacture.

SUMMARY

The disclosed invention relates to a funnel device comprising: a funnel wall, with an interior surface and an exterior surface, the funnel wall generally tapering from an inlet to an outlet; a spout located at the outlet; a reservoir defined generally by the interior surface of the funnel wall; a handle fixedly attached to the funnel wall, the handle located outside of the reservoir; a slideable trigger located on the handle, the trigger slideable with respect to the handle; an annular sealing surface located near the outlet on the interior surface of the funnel wall; a pivotable flapper lever, with a pivot point located generally at a first end of the pivotable flapper lever, rotatably attached to the interior surface of the funnel wall at the pivot point, the pivotable flapper lever having a flapper located generally at a second end of the pivotable flapper lever, and a line attachment point located between the flapper and the pivot point; a passageway in the funnel wall located generally proximal to the trigger; a line with a first end and a second end, the first end attached to the trigger, the second end attached to a line attachment point, and the line entering the reservoir from the trigger via the passageway; a spring attached to the interior surface of the funnel wall and the pivotable flapper lever, and configured to apply a force that tends to keep the flapper sealed against the annular sealing surface.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
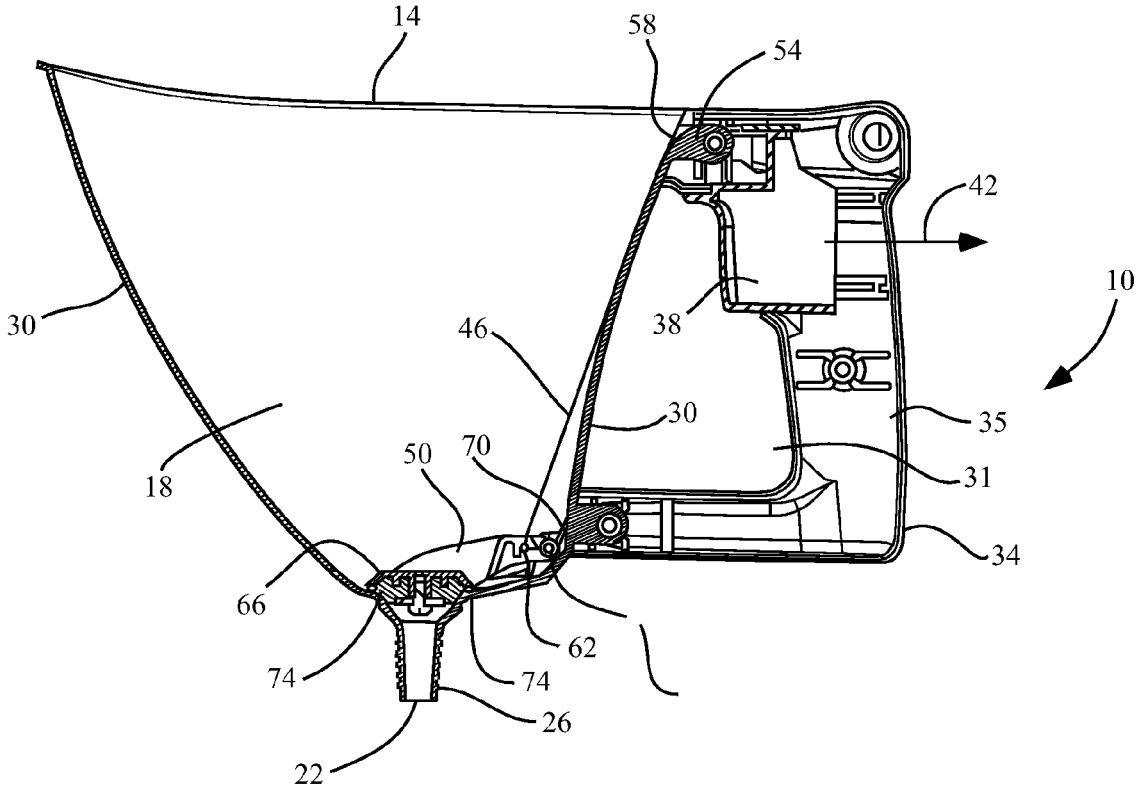
FIG. 1 is a cross-sectional side view of the disclosed funnel.

FIG. 1 is a cross-sectional view of one embodiment of the disclosed funnel 10. The funnel 10 has an opening at its inlet end 14, a reservoir 18 which, in the usual case, tapers downwardly to an outlet end 22. At the outlet end 22 is outlet tube or spout 26. A funnel wall 30 generally defines a funnel shape, inlet end 14, and outlet end 22. The funnel wall 30 will have an interior surface and an exterior surface. The reservoir 18 is generally defined by the interior surface of the funnel wall 30. Attached to the funnel wall 30 is a handle 34. The handle 34 is generally fixed with respect to the funnel wall 30. The handle may have a generally side-ways U shape, with the opening of the U adjacent to the funnel wall 30. Because of the U shape, the handle 34, when attached to the funnel wall 30, has an opening 31, that may be configured for the fingers of a user's hand to fit through when holding on to the handle 34. Additionally, the handle 34 may comprise a grip member 35 that is configured to ergonomically fit a typical user's hand, much like a pistol grip. However, the handle 34 may have any suitable shape. A handle trigger 38, is slideable with respect to the handle 34 and the funnel wall 30. The arrow 42 shows the direction the trigger 38 generally slides in, when the funnel is in a closed configuration. Attached to the trigger 38 is a line 46. The line 46 may be made out of any suitable material, including, but not limited to: nylon coated stainless 7×7 high-flex cable as sold by CarlStahl, 4 North Corporate Drive, Riverdale, N.J. 07457-0300; stainless steel cable, nylon coated stainless steel cable, and vinyl coated stainless steel cable; low stretch stainless steel cable; Teflon® coated stainless steel cable, Dacron® cord assemblies; galvanized steel cable, nylon coated galvanized steel cable, vinyl coated galvanized steel cable, and safety orange vinyl coated galvanized steel cable. The line 46 is attached to a pivotable flapper lever 50. The line 46 is slidable over a curved member 54. The line 46 enters the reservoir 18 at a passageway 56 in the funnel wall 30 that is proximal to the handle 34 and the curved member 54. The pivotable flapper lever 50 acts as a lever with a mechanical advantage. The pivotable flapper lever 50 comprises a pivot point 58 on a first end of the lever, a line attachment point 62 located relatively close to the pivot point 58, and the flapper 66, located on a second end of the lever. The pivot point 58 is rotatably attached to the reservoir. As the trigger 38 is moved in the direction of the arrow 42, the line pulls the pivotable flapper lever 50 up at the attachment point 62. The rotation of the attachment point 62 about the pivot point 58, corresponds to a small translation movement of the attachment point, but a large translation movement of the flapper 66 (as the flapper 66 rotates about the pivot point 58). A spring 70 is attached at or near the pivot point 58. The spring is configured to keep the flapper 66 sealed against the annular sealing surface 74 located adjacent to the outlet tube 26 and located on the inner surface of the funnel wall 30. In this embodiment, the spring 70 is a torsion spring, however, the device can be configured to use other spring types, such as, but not limited to: compression springs, tension springs. In the orientation shown in FIG. 1, with the flapper 66 sealed against the annular sealing surface 74, liquid in the funnel reservoir 18 will be contained in the funnel reservoir 18, so long as the funnel 10 is positioned with the inlet end in a generally up orientation. The spring 70 provides a force to hold the flapper 66 against the annular sealing surface 74.

Figure 2:
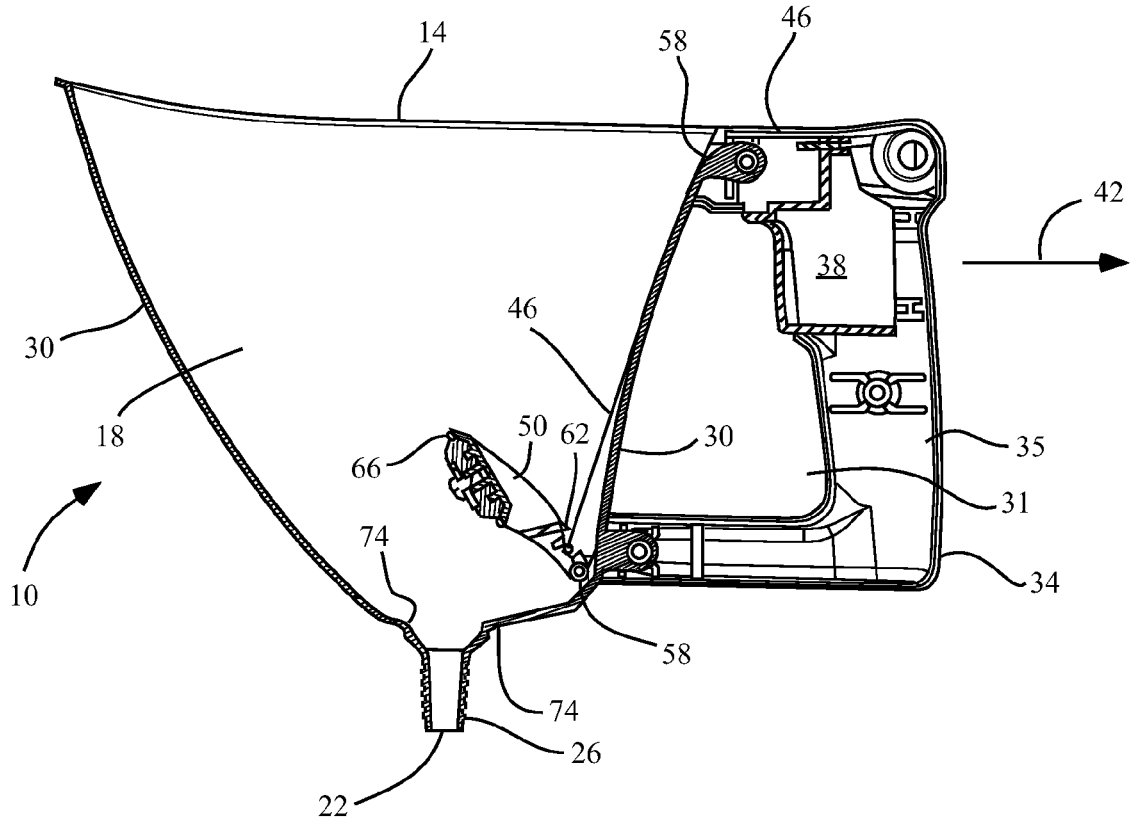
FIG. 2 is a cross-sectional side view of the disclosed funnel from FIG. 1, with the trigger moved to the right of the page.

FIG. 2 shows the disclosed funnel 10 of FIG. 1 with the trigger 38 moved all the way in the direction of the arrow 42, until the trigger is stopped by the handle 34. The line 46, attached to the trigger 38, has pulled up the pivotal flapper lever 50 at the line attachment point 62, thus causing the pivotable flapper lever 50 to rotate about the pivot point 58, further causing the flapper 66 to move away from the annular sealing surface 74. In this orientation, with the flapper 66 up and away from the annular sealing surface 74, liquid in the funnel reservoir 18 will be able to travel out of the reservoir 18 towards the outlet end 22 and out the outlet tube or spout 26. When the trigger 38 is released, the spring 70, will rotate the pivotal flapper lever 50 so that the flapper will seat against the annular sealing surface 74. Additionally, as the flapper 66 moves towards the annular sealing surface 74, the line 46 will pull the trigger in a direction opposite the arrow 42.

Figure 3:
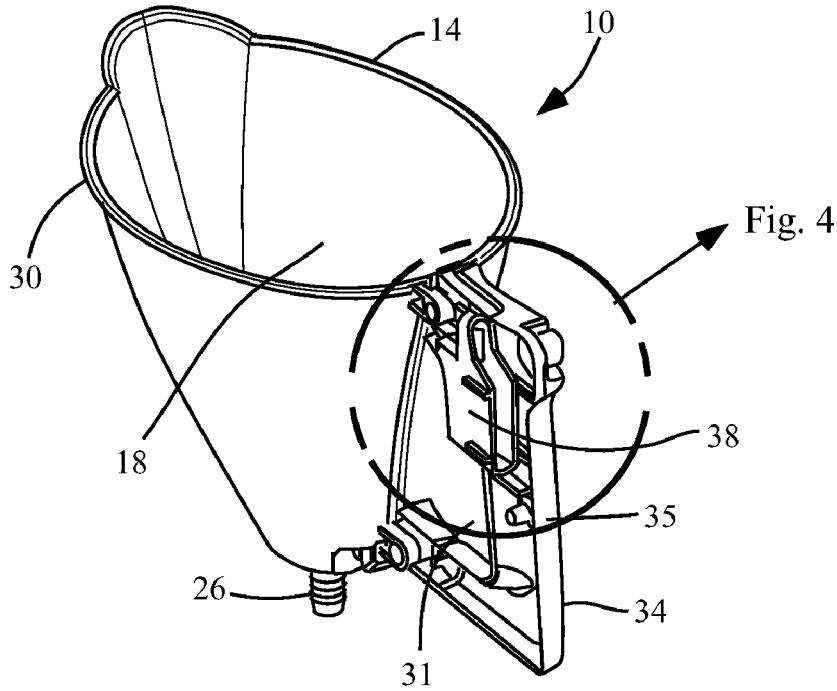
FIG. 3 is a perspective view of the disclosed funnel.
Figure 4:
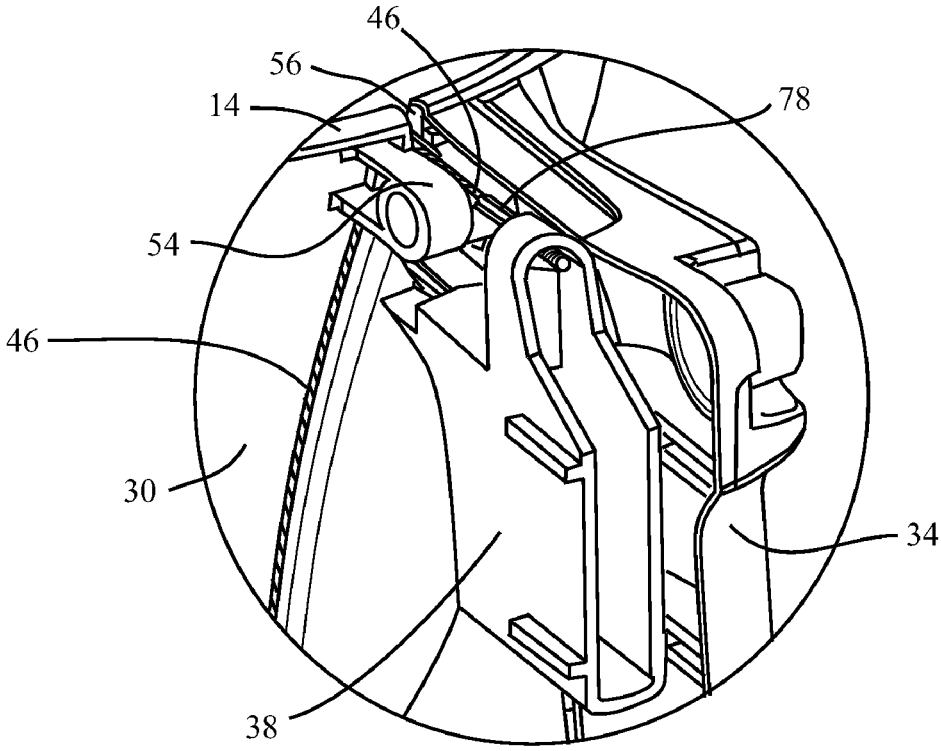
FIG. 4 is a detailed view of the trigger from FIG. 3.

FIGS. 3 shows a perspective view of the funnel 10, with part of the handle 34 removed to show the interior of the handle 34. The pivotal flapper lever 50 is not visible in this view. FIG. 4 shows a close-up view of the trigger and line assembly from FIG. 3. The line 46 is shown connected to the trigger 38 via a threaded member 78 that is screwed into the trigger 38. This is only one means of connecting the line 46 to the trigger, other means are encompassed by this disclosure, such as but not limited to: threading the line through a hole in the trigger, and tying a knot in one end of the line; threading the line through a hole in the trigger and attaching a small object (that is larger than the hole) on end of the line; etc. The line 46 entering the funnel reservoir 18 via the passage way 56 in the funnel wall 30 is more clearly seen in this view.

Figure 5:
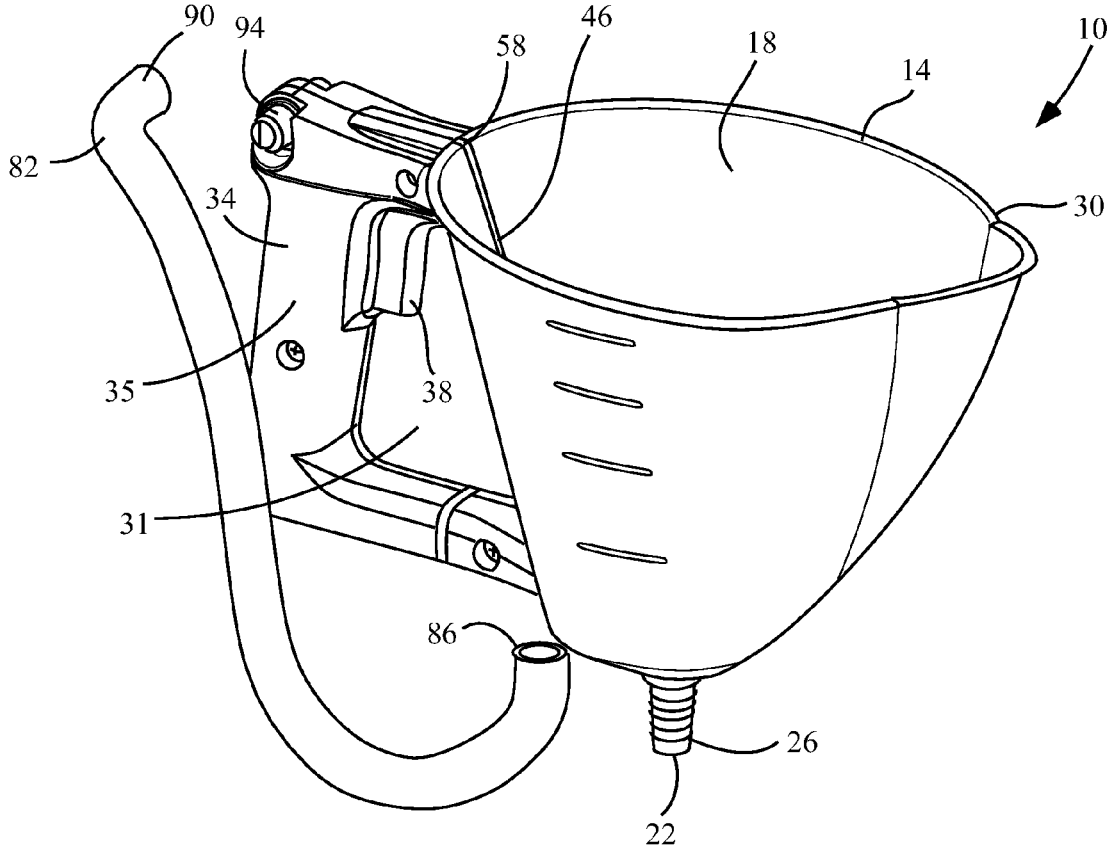
FIG. 5 is a perspective view of the disclosed funnel with a hose accessory.

FIG. 5 shows a perspective view of the funnel 10 with a hose accessory 82. At least one end 86 of the hose accessory 82 is configured to removeably attach to the outlet tube or spout 26. The outlet tube or spout 26 may have a barbed outer surface configured to better attach to the hose accessory 82. The other end 90 of the hose accessory 82 can then be directed to a container, or wherever the user wants to direct liquid that is in the funnel reservoir. In this embodiment, the handle may have a knob 94 configured to allow for attachment of the other end 90 of the hose accessory 82, so the hose can be stored with the funnel 10. The knob 94 may have a barbed outer surface. The hose accessory 82 may be flexible.

The funnel may have a capacity of about 0.5 liters to about 10 liters for individual use. The funnel may have an even larger capacity for industrial use. The hose accessory 82 may have a length of about 6 inches to about 24 inches. The funnel 10 may be generally made out of plastic, fiberglass, or any other suitable material. The hose may have a length of about 7 inches to about 45 inches.

The advantages of the disclosed funnel are that it allows a user to stop and start the flow of liquid out of the funnel manually, simply by pressing the trigger. The disclosed funnel has relatively few moving parts, and is thus simple and inexpensive to manufacture and assemble. The funnel also may have a flexible hose removeably attachable to the outlet end of the funnel, to guide the fluid in the funnel reservoir into a location that the user desires. The flexible hose may be stored on the funnel.

Although the funnel has been described with respect to liquids and fluids, the funnel may be used with solids, such as powders, particulates, gels, and foams.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A funnel device comprising:

a funnel wall, with an interior surface and an exterior surface, the funnel wall generally tapering from an inlet to an outlet;

a spout located at the outlet;

a reservoir defined generally by the interior surface of the funnel wall;

a handle fixedly attached to the funnel wall, the handle located outside of the reservoir;

a slideable trigger located on the handle, the trigger slideable with respect to the handle;

an annular sealing surface located near the outlet on the interior surface of the funnel wall;

a pivotable flapper lever, with a pivot point located generally at a first end of the pivotable flapper lever, rotatably attached to the interior surface of the funnel wall at the pivot point, the pivotable flapper lever having a flapper located generally at a second end of the pivotable flapper lever, and a line attachment point located between the flapper and the pivot point;

a passageway in the funnel wall located generally proximal to the trigger;

a line with a first end and a second end, the first end attached to the trigger, the second end attached to a line attachment point, and the line entering the reservoir from the trigger via the passageway;

a spring attached to the interior surface of the funnel wall and the pivotable flapper lever, and configured to apply a force that tends to keep the flapper sealed against the annular sealing surface.

2. The funnel device of claim 1, wherein the spring is a torsion spring.

3. The funnel device of claim 1, wherein the line attachment point is located closer to the first end of the pivotable flapper lever than to the second end of the pivotable flapper.

4. The funnel device of claim 1, wherein the handle has an opening configured to allow a user's fingers to grasp the handle with the fingers going through the opening.

5. The funnel device of claim 1, wherein the handle comprises a grip member, ergonomically configured to fit a variety hand sizes.

6. The funnel device of claim 1, further comprising a flexible hose with a first end and a second, and wherein at least the first end is removeably attachable to the spout.

7. The funnel device of claim 6, further comprising a knob located on the handle configured to be removeably attached to at least the second end of the flexible hose.

8. The funnel device of claim 1, wherein the spout has a barbed outer surface.

9. The funnel device of claim 7, wherein the knob has a barbed outer surface.

* * * * *